US006598682B2

(12) United States Patent
Johnson et al.

(10) Patent No.: US 6,598,682 B2
(45) Date of Patent: Jul. 29, 2003

(54) RESERVOIR COMMUNICATION WITH A WELLBORE

(75) Inventors: Ashley B. Johnson, Sugar Land, TX (US); James E. Brooks, Manvel, TX (US); Lawrence A. Behrmann, Houston, TX (US); Adinathan Venkitaraman, Houston, TX (US); Ian Walton, Sugar Land, TX (US); Anthony P. Vovers, Houston, TX (US); Vladimir Vaynshteyn, Sugar Land, TX (US); Dinesh R. Patel, Sugar Land, TX (US); Michael W. Fruge, Katy, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 9 days.

(21) Appl. No.: 09/797,209

(22) Filed: Mar. 1, 2001

(65) Prior Publication Data

US 2002/0020535 A1 Feb. 21, 2002

Related U.S. Application Data

(60) Provisional application No. 60/252,754, filed on Nov. 22, 2000, provisional application No. 60/187,900, filed on Mar. 8, 2000, and provisional application No. 60/186,500, filed on Mar. 2, 2000.

(51) Int. Cl.[7] ..... E21B 29/00; E21B 37/00; E21B 43/25

(52) U.S. Cl. ..... 166/370; 166/297; 166/311; 166/55.1; 166/163

(58) Field of Search ..... 166/311, 297, 166/298, 65, 370, 55.1, 55.2, 163, 164, 165

(56) References Cited

U.S. PATENT DOCUMENTS 3,760,878 A 9/1973 Peevey (List continued on next page.)

FOREIGN PATENT DOCUMENTS

WO WO 99/42696 8/1999
WO WO 01/25595 A1 4/2001

OTHER PUBLICATIONS

Scott, Wu and Bridges, "Air Foam Improves Efficiency of Completion and Workover Operations in Low–Pressure Gas Wells", SPE 27922, Dec., 1995, pp. 219–225.

(List continued on next page.)

*Primary Examiner*—David Bagnell
*Assistant Examiner*—Jennifer R Dougherty
(74) *Attorney, Agent, or Firm*—Trop, Pruner & Hu P.C.; Jeffrey Griffin; Brigitte Jeffrey

(57) ABSTRACT

A method and apparatus for improving reservoir communication includes, in one arrangement, use of one or more chambers to create an underbalance condition and/or a fluid surge in the wellbore. In another arrangement, a tool string comprises a packer, a circulating valve, and an atmospheric chamber, in which the circulating valve, when open, is adapted to vent a lower wellbore region below the packer when the packer is set, and the atmospheric chamber is capable of being operated to create an underbalance condition below the packer. In yet another arrangement, an apparatus comprises a subsea wellhead equipment including a blow-out preventer, choke line filled with a low density fluid, and a kill line filled with a heavy fluid. The choke line is adapted to be opened to create an underbalance condition in the wellbore. In yet another arrangement, a method of creating an underbalance condition comprises controlling wellbore pressure at least in a perforating interval to achieve a target level, configuring a perforating gun to achieve a target detonation pressure in the perforating gun upon detonation, and creating an underbalance condition in the perforating interval of the wellbore when the perforating gun is shot. In yet another arrangement, a tool string for use in a wellbore extending from a well surface comprises a closure member adapted to be positioned below the well surface, and a chamber defined at least in part by the closure member. The tool string further comprises at least a port selectively openable to enable communication between the chamber and a wellbore region. The port when open creates a fluid surging to the chamber to provide a low pressure condition in the wellbore region. A tool in the tool string is adapted to perform an operation in the low pressure condition.

37 Claims, 14 Drawing Sheets

U.S. PATENT DOCUMENTS

| | | | | |
|---|---|---|---|---|
| 4,175,042 | A | | 11/1979 | Mondshine |
| 4,372,384 | A | | 2/1983 | Kinney |
| 4,484,632 | A | * | 11/1984 | Vann ..... 166/297 |
| 4,576,233 | A | | 3/1986 | George |
| 4,619,325 | A | | 10/1986 | Zunkel |
| 4,621,692 | A | | 11/1986 | Mondshine |
| 4,650,010 | A | | 3/1987 | George et al. |
| 4,804,044 | A | | 2/1989 | Wesson et al. |
| 4,805,726 | A | | 2/1989 | Taylor et al. |
| 5,103,912 | A | * | 4/1992 | Flint ..... 166/297 |
| 5,135,051 | A | | 8/1992 | Facteau et al. |
| 5,228,508 | A | | 7/1993 | Facteau et al. |
| 5,318,126 | A | | 6/1994 | Edwards et al. |
| 5,635,636 | A | | 6/1997 | Alexander |
| 6,173,783 | B1 | | 1/2001 | Abbott-Brown et al. |
| 6,206,100 | B1 | | 3/2001 | George et al. |
| 6,220,355 | B1 | | 4/2001 | French |

OTHER PUBLICATIONS

Overview of Implo Treat pamphlet, Implo Treat Systems, Jan. 17, 2000 (4 pages).

* cited by examiner

RESERVOIR COMMUNICATION WITH A WELLBORE

This claims the benefit of U.S. Provisional Application Ser. Nos. 60/186,500, filed Mar. 2, 2000; 60/187,900, filed Mar. 8, 2000; and 60/252,754, filed Nov. 22, 2000.

TECHNICAL FIELD

The invention relates to improving reservoir communication within a wellbore.

BACKGROUND

To complete a well, one or more formation zones adjacent a wellbore are perforated to allow fluid from the formation zones to flow into the well for production to the surface or to allow injection fluids to be applied into the formation zones. A perforating gun string may be lowered into the well and the guns fired to create openings in casing and to extend perforations into the surrounding formation.

The explosive nature of the formation of perforation tunnels shatters sand grains of the formation. A layer of "shock damaged region" having a permeability lower than that of the virgin formation matrix may be formed around each perforation tunnel. The process may also generate a tunnel full of rock debris mixed in with the perforator charge debris. The extent of the damage, and the amount of loose debris in the tunnel, may be dictated by a variety of factors including formation properties, explosive charge properties, pressure conditions, fluid properties, and so forth. The shock damaged region and loose debris in the perforation tunnels may impair the productivity of production wells or the injectivity of injector wells.

One popular method of obtaining clean perforations is underbalanced perforating. The perforation is carried out with a lower wellbore pressure than the formation pressure. The pressure equalization is achieved by fluid flow from the formation and into the wellbore. This fluid flow carries some of the damaging rock particles. However, underbalance perforating may not always be effective and may be expensive and unsafe to implement in certain downhole conditions.

Fracturing of the formation to bypass the damaged and plugged perforation may be another option. However, fracturing is a relatively expensive operation. Moreover, clean, undamaged perforations are required for low fracture initiation pressure (one of the pre-conditions for a good fracturing job). Acidizing, another widely used method for removing perforation damage, is not effective for treating sand and loose debris left inside the perforation tunnel.

A need thus continues to exist for a method and apparatus to improve fluid communication with reservoirs in formations of a well.

SUMMARY

In general, according to one embodiment, a tool string for use in a wellbore extending from a well surface comprises a closure member adapted to be positioned below the well surface and a low pressure chamber defined at least in part by the closure member. At least a port is selectively openable to enable communication between the chamber and a wellbore region. The at least one port when opened creates a fluid surge into the chamber to provide a local low pressure condition in the wellbore region. A tool in the tool string is adapted to perform an operation in the local low pressure condition.

In general, according to one embodiment, a tool string for use in a wellbore comprises an assembly having at least a first chamber and a second chamber, and control elements to enable communication with the first chamber to create an underbalance condition in the wellbore and to enable communication with the second chamber to create a flow surge from a formation.

In general, according to another embodiment, a method for use in a wellbore comprises lowering a tool string having a first chamber into the wellbore proximal a formation and activating at least one explosive element to open communication with the chamber to create an underbalance condition in the wellbore proximal the formation.

In general, according to another embodiment, a tool string for use in a wellbore comprises a packer, a circulating valve, and an atmospheric chamber. The circulating valve, when open, is adapted to vent a lower wellbore region below the packer once the packer is set, and the atmospheric chamber is capable of being opened to create an underbalance condition below the packer.

In general, according to another embodiment, an apparatus for use with a wellbore comprises subsea wellhead equipment including a blow-out preventer, a choke line filled with a low density fluid, and a kill line filled with a heavy fluid. A downhole string is positioned below the subsea wellhead equipment, and the choke line is adapted to be open to create an underbalance condition in the wellbore.

In general, according to another embodiment, a method of creating an underbalance condition in a wellbore comprises controlling wellbore pressure at least in a perforating interval to achieve a target level and configuring a perforating gun to achieve a target detonation pressure in the perforating gun upon detonation. An underbalance condition in the perforating interval of the wellbore is created when the perforating gun is shot.

Other or alternative features will become apparent from the following description, from the drawings and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and "downwardly"; "upstream" and "downstream"; "above" and "below" and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Generally, a method and apparatus is provided for creating a local low pressure condition in a wellbore. In some embodiments, the local low pressure condition is created by use of a chamber containing a relatively low fluid pressure. For example, the chamber is a sealed chamber containing a gas or other fluid at a lower pressure than the surrounding wellbore environment. As a result, when the chamber is opened, a sudden surge of fluid flows into the lower pressure chamber to create the local low pressure condition in a wellbore region in communication with the chamber after the chamber is opened.

In some embodiments, the chamber is a closed chamber that is defined in part by a closure member located below the surface of the well. In other words, the closed chamber does not extend all the way to the well surface. For example, the closure member may be a valve located downhole. Alternatively, the closure member includes a sealed container having ports that include elements that can be shattered by some mechanism (such as by the use of explosive or some other mechanism). The closure member may be other types of devices in other embodiments.

In accordance with a first embodiment, a method and apparatus provides for treatment of perforation damage and for the removal of perforation generated (charge and formation) debris from the perforation tunnels. In this first embodiment, a sealed atmospheric container is lowered into the wellbore after a formation has been perforated. After production is started, openings are created (such as by use of explosives, valves, or other mechanisms) in the housing of the container to generate a sudden underbalance condition or fluid surge to remove the damaged sand grains around the perforation tunnels and to remove loose debris.

Figure 1C:
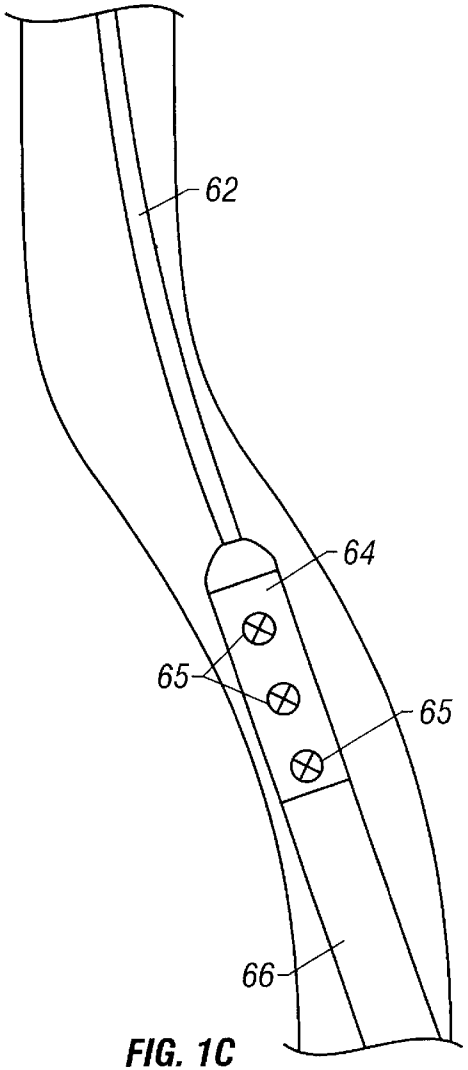
FIGS. 1A–1C illustrate different embodiments of strings each employing an apparatus to generate a local low pressure condition.
Figure 1B:
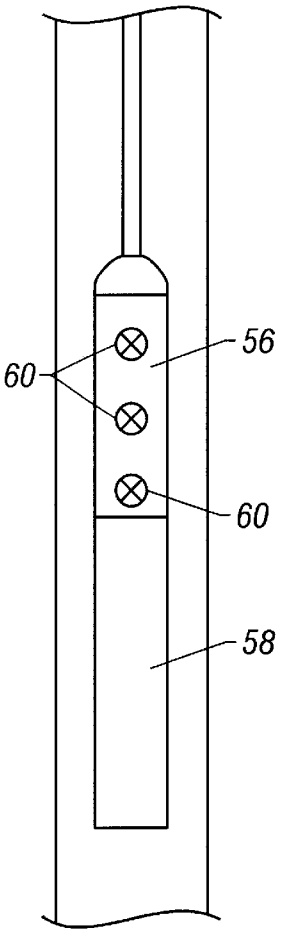
Figure 1A:
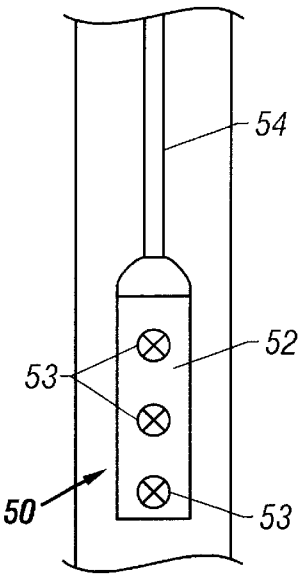

Another application of creating a local low pressure condition or fluid surge in a wellbore region is to clean filter cake from open hole sections. Using an apparatus 52 (FIG. 1A) according to some embodiments of the invention, localized cleanup of a target open hole section 50 can be performed. The apparatus 52 includes one or more ports 53 that are selectively openable to enable communication with an inner, lower pressure chamber inside the apparatus 52. The ports 53 can be actuated opened by use of a valve, an explosive, or some other mechanisms. In conventional global cleanup operations in which the entire well is treated, high permeability sections are preferentially treated, which may cause other open hole sections to be under-treated. By using local fluid surges to perform the cleanup, more focused treatment can be accomplished. The apparatus 52 is run to a desired depth on a carrier line 54 (e.g., coiled tubing, wireline, slickline, etc.).

Another drawback of global well treatments involving drawdown of the well is that the drawdown can be limited by surface equipment capacity to handle produced hydrocarbons. By using localized fluid surges according to some embodiments, a higher local drawdown in a given wellbore section can be achieved to enhance cleanup operations.

Yet another application of creating local low pressure conditions is the enhancement of the performance of jet cutter equipment. A jet cutter is a chemical cutter that uses chemical agents to cut through downhole structures. The performance of a jet cutter can be adversely affected if the jet cutter is operated in a relatively high fluid pressure environment. An apparatus 56 (FIG. 1B) according to some embodiments can be used to create a local low pressure condition proximal a jet cutter 58 to enhance jet cutter performance. The apparatus 56 includes one or more selectively openable ports 60. In another embodiment, the jet cutter 50 can be substituted with a perforating gun, with the apparatus 56 used to create an underbalance condition to perform underbalance perforating. Alternatively, in the perforating gun example, the apparatus 56 can be used to create a fluid surge after perforating has been performed.

Another application of some embodiments is the use of a pressure surge apparatus 64 (FIG. 1C) as a fishing aid. The pressure surge apparatus 64 generates a local pressure surge when one or more ports 65 are opened to help remove a differential sticking force that causes a string to be stuck in a wellbore. The string includes a carrier line 62, the pressure surge apparatus 64, and a tool 66, in one example. The creation of a pressure surge can cause application of an axial force on the string to help dislodge the string from its stuck position.

In each of the examples, and in other examples described below, various mechanisms can be used to provide the low pressure in a chamber. For example, tubing or control line can be used to communication the low pressure. Alternatively, the low pressure is carried in a sealed container into the wellbore. In a subsea application, the low pressure can be communicated through a choke line or kill line.

In accordance with other embodiments, a tool string including multiple chambers and a perforating gun is lowered into the wellbore. In these other embodiments, a first chamber is used to create an underbalance condition prior to perforating. The perforating gun is then fired, following which the perforating gun is released. After the perforating gun has dropped away from the perforated formation, a second chamber is opened to create a flow surge from the formation into the second chamber. After a surge of a predetermined volume of formation fluid into the second chamber, a flow control device may be opened to inject fluid in the second chamber back into the formation. Alternatively, the formation fluid in the second chamber may be produced to the surface.

In accordance with yet another embodiment, an underbalance condition may be created by using a choke line and a kill line that are part of subsea well equipment in subsea wells. In this other embodiment, the choke line, which extends from the subsea well equipment to the sea surface, may be filled with a low density fluid, while the kill line, which also extends to the sea surface, may be filled with a heavy wellbore fluid. Once the tool string is run into the wellbore, a blow-out preventer (BOP), which is part of the subsea well equipment, may be closed, followed by opening of the choke line below the BOP and the closing of the kill line below the BOP. Opening of the choke line and closing of the kill line causes a reduction in the hydrostatic head in the wellbore to create an underbalance condition.

In yet another embodiment, a chamber within the gun can be used as a sink for wellbore fluids to generate the underbalance condition. Following charge combustion, hot detonation gas fills the internal chamber of the gun. If the resultant detonation gas pressure is less than the wellbore pressure, then the cooler wellbore fluids are sucked into the gun housing. The rapid acceleration through perforation ports in the gun housing breaks the fluid up into droplets and results in rapid cooling of the gas. Hence, rapid gun pressure loss and even more rapid wellbore fluid drainage occurs, which generates a drop in the wellbore pressure. The drop in wellbore pressure creates an underbalance condition.

Figure 2A:
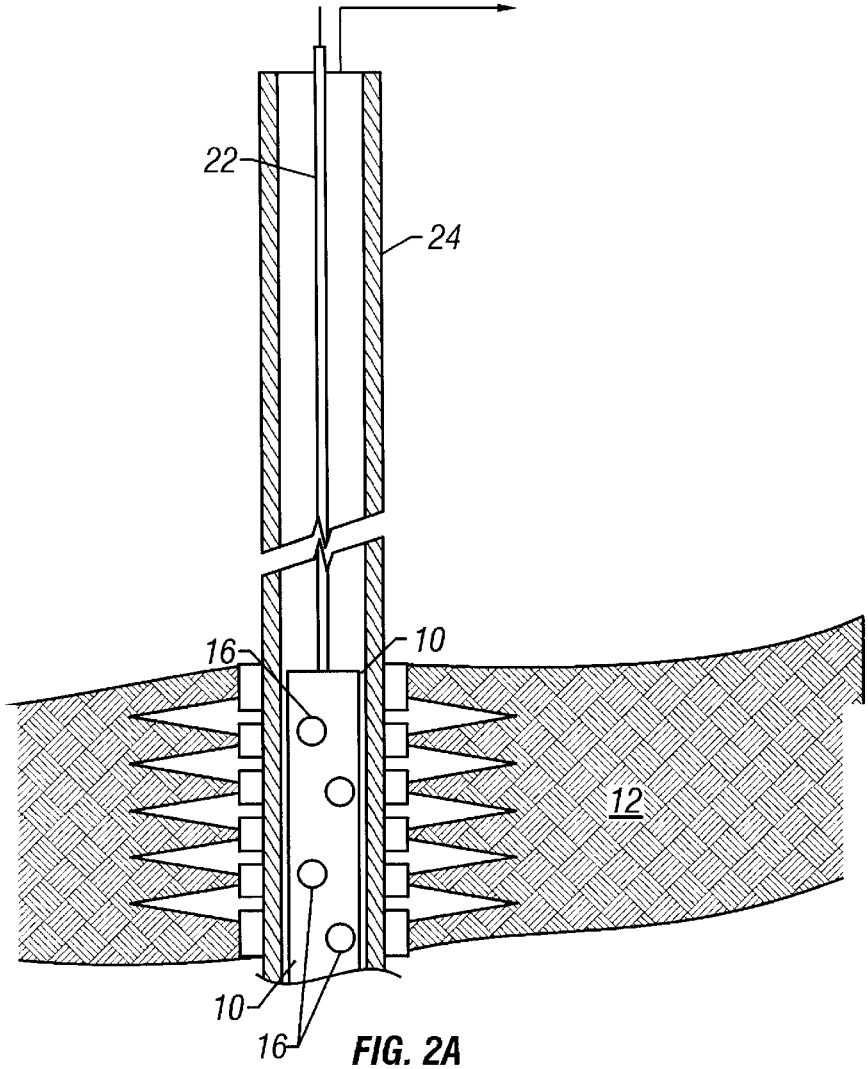
FIGS. 2A and 2C illustrate tool strings according to two embodiments for creating an underbalance condition in a wellbore for perforating.

Referring to FIG. 2A, a tool string having a sealed atmospheric container 10 (or container having an inner pressure that is lower than an expected pressure in the wellbore in the interval of the formation 12) is lowered into a wellbore (which is lined with casing 24) and placed adjacent a perforated formation 12 to be treated. The tool string is lowered on a carrier line 22 (e.g., wireline, slickline, coiled tubing, etc.). The container 10 includes a chamber that is filled with a gas (e.g., air, nitrogen) or other fluid. The container 10 has a sufficient length to treat the entire formation 12 and has multiple ports 16 that can be opened up using explosives.

Figure 2B:
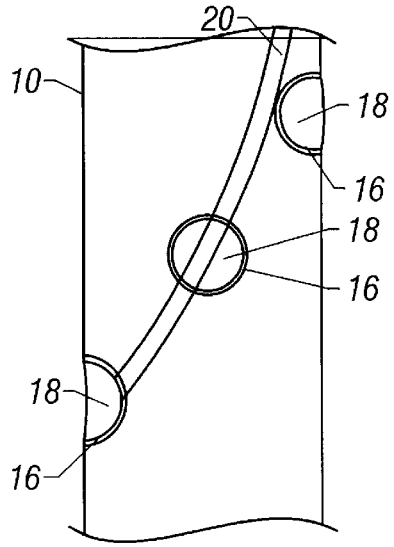
FIG. 2B illustrates a container including an atmospheric chamber, the container having ports that are explosively actuatable in accordance with one embodiment.

As shown in FIG. 2B, the ports 16 may include openings that are plugged with sealing elements 18 (e.g., elastomer elements, ceramic covers, etc.). An explosive, such as a detonating cord 20, is placed in the proximity of each of the ports 16. Activation of the detonating cord 20 causes the sealing elements 18 to shatter or break away from corresponding ports 16. In another embodiment, the ports 16 may include recesses, which are thinned regions in the housing of the container 10. The thinned regions allow easier penetration by explosive forces.

In one embodiment, while the well is producing (after perforations in the formation 12 have been formed), the atmospheric chamber in the container 10 is explosively opened to the wellbore. This technique can be used with or without a perforating gun. When used with a gun, the atmospheric container allows the application of a dynamic underbalance even if the wellbore fluid is in overbalance just prior to perforating. The atmospheric container 10 may also be used after perforation operations have been performed. In this latter arrangement, production is established from the formation, with the ports 16 of the atmospheric container 10 explosively opened to create a sudden underbalance condition.

As discussed above, there are several potential mechanisms of damage to formation productivity and injectivity due to perforation. One may be the presence of a layer of low permeability sand grains (grains that are fractured by the shaped charge) after perforation. As the produced fluid from the formation may have to pass through this lower permeability zone, a higher than expected pressure drop may occur resulting in lower productivity. Underbalance perforating is one way of reducing this type of damage. However, in many cases, insufficient underbalance may result in only partial alleviation of the damage. The second major type of damage may arise from loose perforation-generated rock and charge debris that fills the perforation tunnels. Not all the particles may be removed into the wellbore during underbalance perforation, and these in turn may cause declines in productivity and injectivity (for example, during gravel packing, injection, and so forth). Yet another type of damage occurs from partial opening of perforations. Dissimilar grain size distribution can cause some of these perforations to be plugged (due to bridging, at the casing/cement portion of the perforation tunnel), which may lead to loss of productivity and injectivity.

To remedy these types of damage, two forces acting simultaneously may be needed, one to free the particles from forces that hold them in place and another to transport them. The fractured sand grains in the perforation tunnel walls may be held in place by rock cementation, whereas the loose rock and sand particles and charge debris in the tunnel may be held in place by weak electrostatic forces. Sufficient fluid flow velocity is required to transport the particles into the wellbore.

The explosively actuated container 10 in accordance with one embodiment includes air (or some other suitable gas or fluid) inside. The dimensions of the chamber 10 are such that it can be lowered into a completed well either by wireline, coiled tubing, or other mechanisms. The wall thickness of the chamber is designed to withstand the downhole wellbore pressures and temperatures. The length of the chamber is determined by the thickness of perforated formation being treated. Multiple ports 16 may be present along the wall of the chamber 10. Explosives are placed inside the atmospheric container in the proximity of the ports. The explosives may include a detonating cord (such as 20 in FIG. 2B) or even shaped charges.

In one arrangement, the tool string including the container 10 is lowered into the wellbore and placed adjacent the perforated formation 12. In this arrangement, the formation 12 has already been perforated, and the atmospheric chamber 10 is used as a surge generating device to generate a sudden underbalance condition. Prior to lowering the atmospheric container, a clean completion fluid may optionally be injected into the formation. The completion fluid is chosen based on the formation wettability, and the fluid properties of the formation fluid. This may help in removing particulates from the perforation tunnels during fluid flow.

After the atmospheric container 10 is lowered and placed adjacent the perforated formation 12, the formation 12 is flowed by opening a production valve at the surface. While the formation is flowing, the explosives are set off inside the atmospheric container, opening the ports of the container 10 to the wellbore pressure. The shock wave generated by the explosives may provide the force for freeing the particles. The sudden drop in pressure inside the wellbore may cause the fluid from the formation to rush into the empty space left in the wellbore by the atmospheric container 10. This fluid carries the mobilized particles into the wellbore, leaving clean formation tunnels. The chamber may be dropped into the well or pulled to the surface.

Figure 2C:
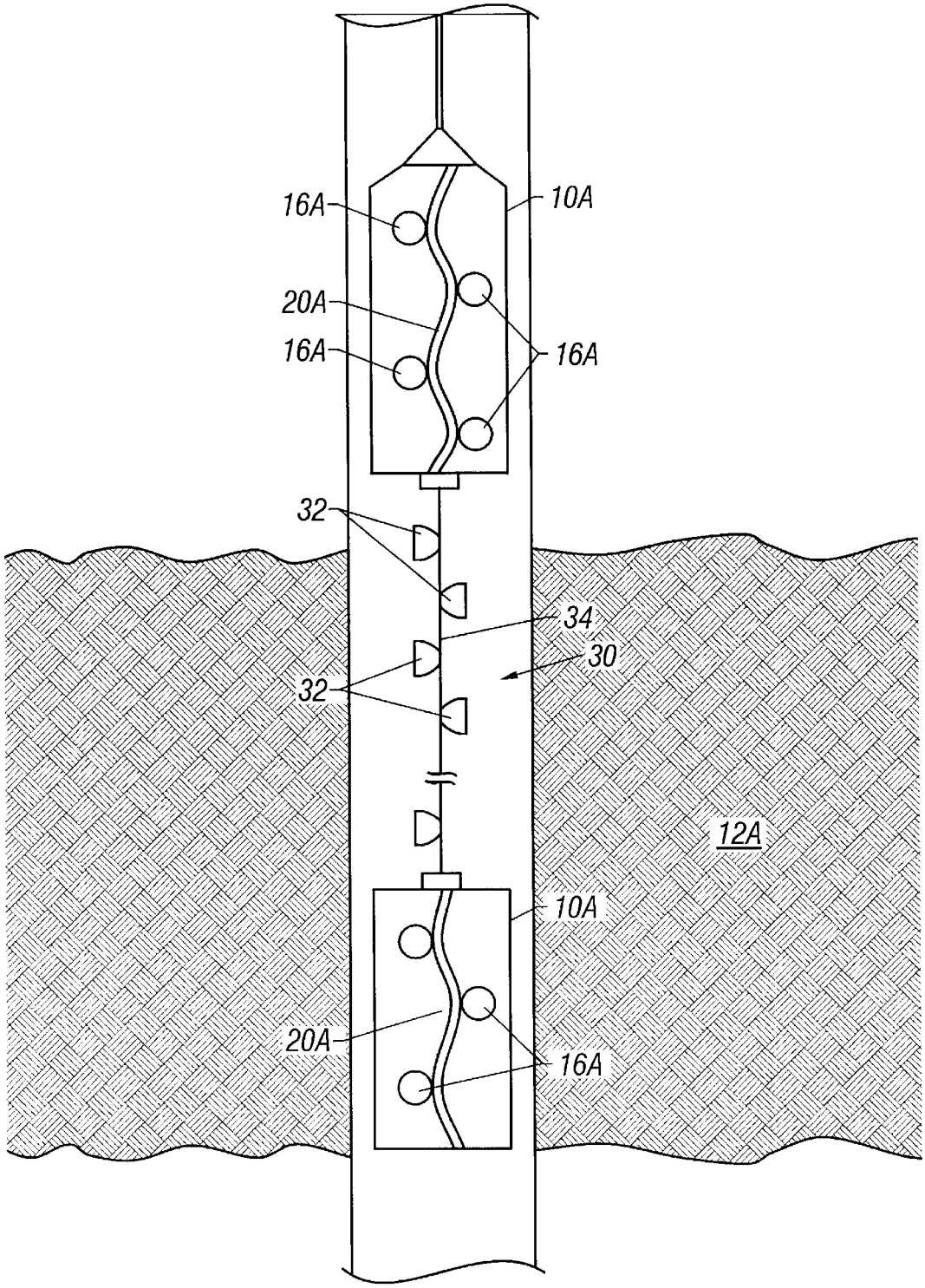

If used with a perforating gun, activation of the perforating gun may substantially coincide with opening of the ports 16. This provides underbalanced perforation. Referring to FIG. 2C, use of an atmospheric container 10A in conjunction with a perforating gun 30, in accordance with another embodiment, is illustrated. In the embodiment of FIG. 2C, the container 10A is divided into two portions, a first portion above the perforating gun 30 and a second portion below the perforating gun 30. The container 10A includes various openings 16A that are adapted to be opened by an explosive force, such as an explosive force due to initiation of a detonating cord 20A or detonation of explosives connected to the detonating cord 20A. The detonating cord is also connected to shaped charges 32 in the perforating gun 30. In one embodiment, as illustrated, the perforating gun 30 can be a strip gun, in which capsule shaped charges are mounted on a carrier 34. Alternatively, the shaped charges 32 may be non-capsule shaped charges that are contained in a sealed container.

The fluid surge can be performed relatively soon after perforating. For example, the fluid surge can be performed within about one minute after perforating. In other embodiments, the pressure surge can be performed within (less than or equal to) about 10 seconds, one second, or 100 milliseconds, as examples, after perforating. The relative timing between perforation and fluid flow surge is applicable also to other embodiments described herein.

Figure 3:
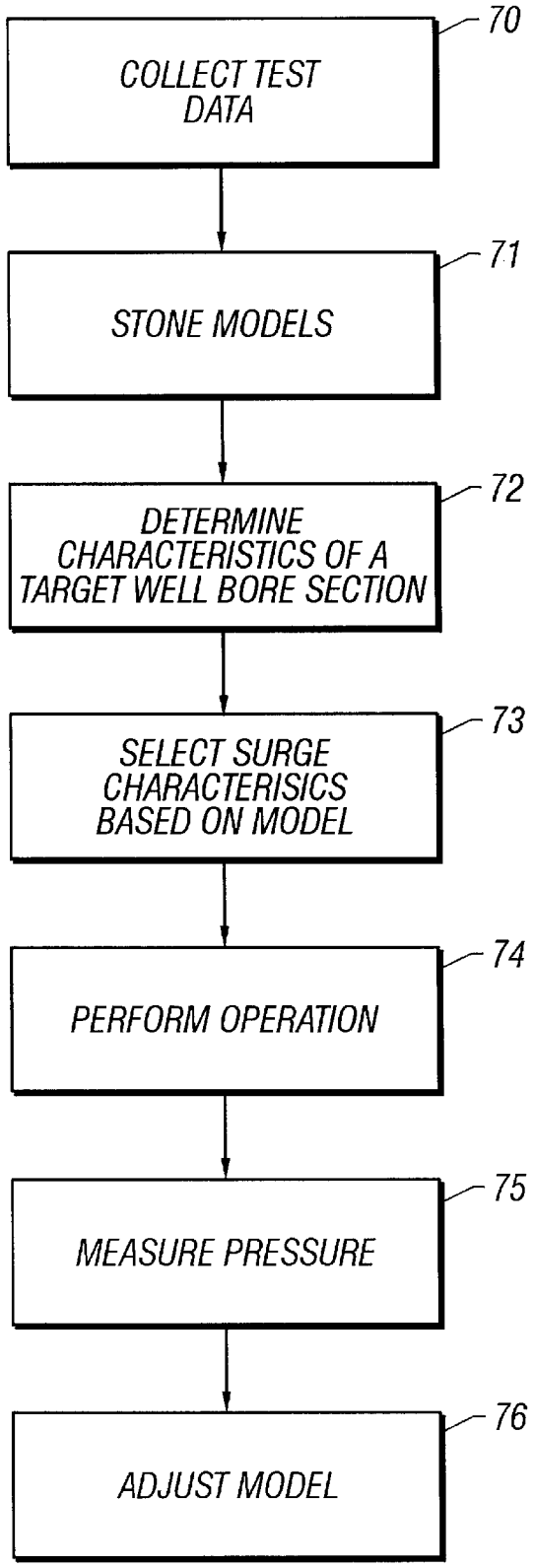
FIG. 3 is a flow diagram of a process of selecting characteristics of a fluid flow surge based on wellbore characteristics.

The characteristics (including the timing relative to perforating) of the fluid surge can be based on characteristics (e.g., wellbore diameter, formation pressure, hydrostatic pressure, formation permeability, etc.) of the wellbore section in which the local low pressure condition is to be generated. Generally, different types of wellbores having different characteristics. In addition to varying timing of the surge relative to the perforation, the volume of the low pressure chamber and the rate of fluid flow into the chamber can be controlled. Referring to FIG. 3, tests can be performed on wells of different characteristics, with the tests involving creation of pressure surges of varying characteristics to test their effectiveness. The test data is collected (at 70), and the optimum surge characteristics for a given type of well are stored (at 71) in models for later access.

When a target well in which a local surge operation is identified, the characteristics of the well are determined (at 73) and matched to one of the stored models. Based on the model, the surge characteristics are selected (at 74), and the operation involving the surge is performed (at 75). As part of the operation, the pressure condition and other well conditions in the wellbore section resulting from the surge can be measured (at 75), and the model is adjusted (at 76) if necessary for future use.

The downhole pressure and other well conditions are measured using gauges or sensors run into the wellbore with the string. As a further refinement, the gauges or sensors can collect data at a relatively fast sampling rate. Based on the measurements, a different model may be selected (during the operation) to vary the relative timing of the perforation and surge.

Figure 4:
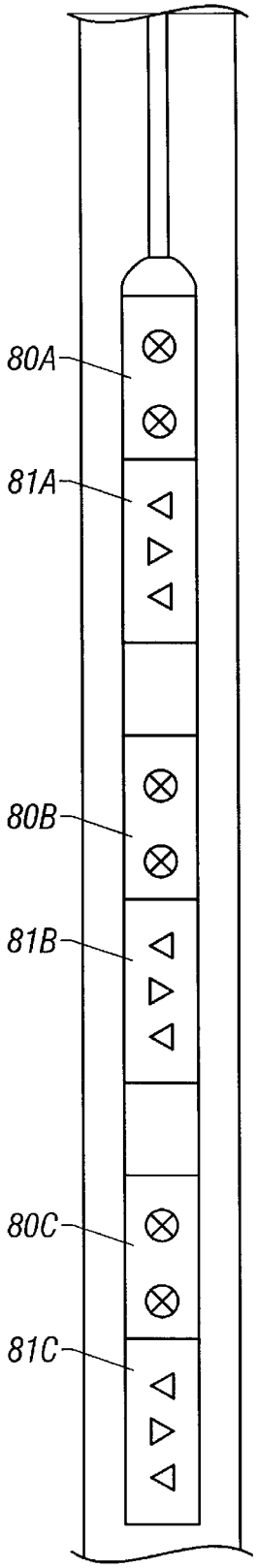
FIG. 4 illustrates a string having plural sections, each section including a perforating gun and an apparatus to create an underbalance condition or surge.

Even though the described embodiments describe a single perforating operation followed by a single surge operation, other embodiments can involve multiple perforating and surge operations. For example, referring to FIG. 4, a string includes three sections that are activate at different times. Other examples can involve a lower number or greater number of sections. The string includes low pressure or surge apparatus 80A, 80B, and 80C, and corresponding perforating guns 81A, 81B, 81C. The first section (80A, 81A) can be activated first, followed sequentially by activation of the second (80B, 81 B) and third (80C, 81C) sections. The delay between activation of the different sections can be set to predetermined time delays. As discussed here, activation of a section can refer to activating the perforating gun 81 followed by opening the apparatus 80 to generate a surge. Alternatively, activation of a section can refer to opening the apparatus 80 to generate an underbalance condition followed by activation of the perforating gun 81 to perform underbalanced shooting.

Figure 5:
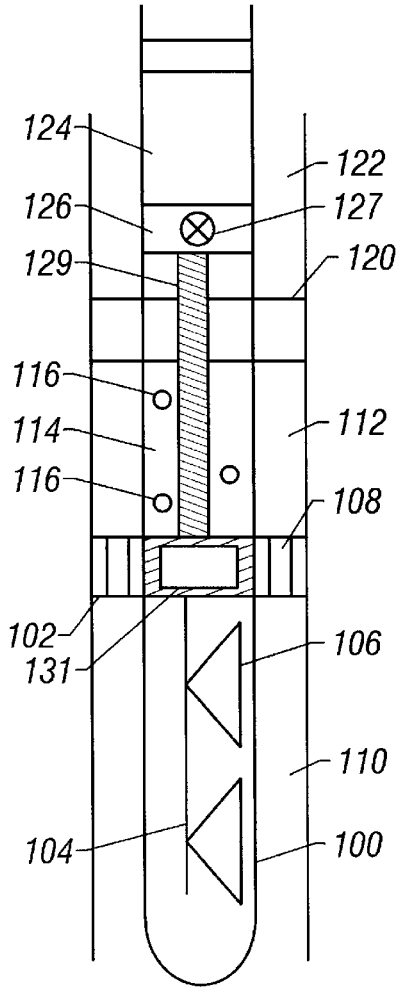
FIG. 5 illustrates a tool string according to another embodiment for creating an underbalance condition for a perforating operation followed by creating a flow surge from a target formation.

Referring to FIG. 5, in accordance with another embodiment, a tool string with plural chambers may be employed. The tool string includes a perforating gun 100 that is attached to an anchor 102. The anchor 102 may be explosively actuated to release the perforating gun 100. Thus, for example, activation of a detonating cord 104 to fire shaped charges 106 in the perforating gun 100 will also actuate the anchor 102 to release the perforating gun 100, which will then drop to the bottom of the wellbore.

The anchor 102 includes an annular conduit 108 to enable fluid communication in the annulus region 110 (also referred to as a rat hole) with a region outside a first chamber 114 of the tool string. The first chamber 114 has a predetermined volume of gas or fluid. As with the atmospheric container 10 of FIGS. 2A, 2B, and 2C, the housing defining the first chamber 114 may include ports 116 that can be opened, either explosively or otherwise. The volume of the first chamber 114 in one example may be approximately 7 liters or 2 gallons. This is provided to achieve roughly a 200 psi (pounds per square inch) underbalance condition in the annulus region 110 when the ports 116 are opened. In other configurations, other sizes of the chamber 114 may be used to achieve a desired underbalance condition that is based on the geometry of the wellbore and the formation pressure. A control module 126 may include a firing head (or other activating mechanism) to initiate a detonating cord 129 (or to activate some other mechanism) to open the ports 116.

A packer 120 is set around the tool string to isolate the region 112 from an upper annulus region 122 above the packer 120. Use of the packer 120 provides isolation of the rat hole so that a quicker response for the underbalance condition or surge can be achieved. However, in other embodiments, the packer 120 may be omitted. Generally, in the various embodiments described herein, use of a packer for isolation or not of the annulus region is optional.

The tool string of FIG. 5 also includes a second chamber 124. The control module 126 may also include a flow control device 127 (e.g., a valve) to control communication of well fluids from the first chamber 114 to the second chamber 124. During creation of the underbalance condition, the flow control device 127 is closed.

Figure 6:
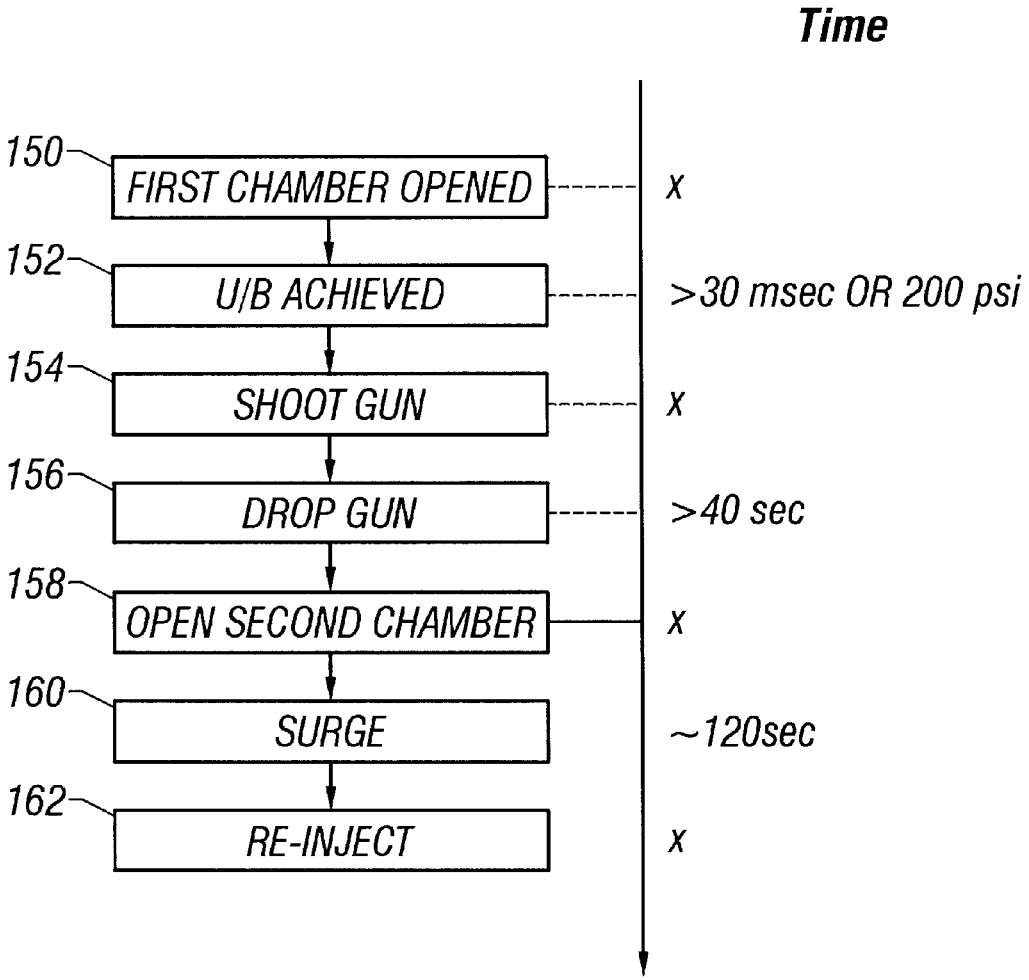
FIG. 6 is a timing diagram of a sequence of events performed by the tool string of FIG. 5.

Referring further to FIG. 6, operation of the tool string of FIG. 5 is described. After the tool string is positioned downhole, the first chamber 114 may be opened (at 150) to enable creation of an underbalance condition in the lower region 110 of the wellbore. Depending on the volume of the first chamber 114 and other factors (including the location of the chamber and length of the guns), the time to achieve a desired underbalance condition (at 152) may vary. For example, to achieve about a 200 psi underbalance condition with a first chamber 114 having a volume of approximately 7 liters and the gun string having a length of approximately 150 ft., the time required may be greater than about 30 milliseconds (ms). The numbers given in the example are provided for illustration purposes only, and are not intended to limit the scope of the invention.

A delay is thus provided between the opening of the ports 116 of the first chamber 114 and firing of the perforating gun 100. This delay may be provided by a downhole timer mechanism 131 or by independent control (in the form of commands such as elevated pressure or pressure pulse signals communicated through the annulus 122, such as to a downhole control module coupled to the detonating cord 104). Alternatively, sensors may be placed downhole to check for the underbalance condition.

Once the underbalance condition is achieved, the perforating gun 100 is fired (at 154). If a check determines that the underbalance condition is not present, then firing of the gun 100 may be prevented. Firing of the perforating gun 100 may also activate the anchor 102 to release the gun 100, which is then dropped (at 156) to the bottom of the wellbore. The time to clear the formation depends on the length of the gun 100 and deviation of the well. For example, if the gun length is about 100 feet in a 60° deviated well, then it may take about 40 seconds for top of the gun to clear perforated formation. After the appropriate delay, the flow control device 127 in the control module 126 is opened (at 158) to enable a fluid flow surge into the second chamber 124. The volume of the second chamber 124 depends on the amount of surge desired. For example, the volume may be about 40 barrels (bbl). This may take about 120 seconds to fill.

Following the surge operation (at 160) and after some predetermined delay set by a timer mechanism, surface control, or measurement of downhole condition, a valve (not shown) further up the wellbore may be opened and injection pressure applied to inject fluid (at 162) in the second chamber 124 back into the formation. This is particularly useful in subsea applications, where production of fluid to the surface is undesirable. In an alternative embodiment, if the well is a land well, the fluid in the second chamber 124 may be produced to the surface. To produce fluid from the chamber 124, the flow control device in the control module 126 may be closed to isolate the second chamber 124 from the formation.

Figure 7:
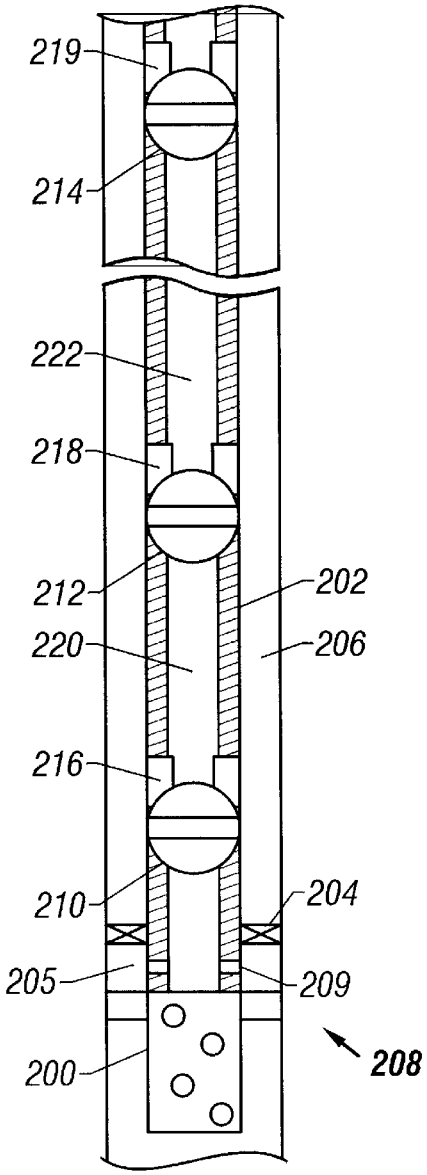
FIG. 7 illustrates a tool string according to a further embodiment for creating an underbalance condition for a perforating operation followed by creating a flow surge from a target formation.

Referring to FIG. 7, a tool string according to yet another embodiment is illustrated. The operations performed by the tool string are similar to those described above in connection with FIGS. 5 and 6. The tool string includes a perforating gun 200 attached below a tubing 202. A packer 204 set around the tubing 202 isolates the annulus region 206 from the target formation 208.

The tubing 202 may be attached to three valves 210, 212, and 214. As illustrated, in one embodiment, the valves 210, 212, and 214 are ball valves. Alternatively, the valves may be sleeve valves, flapper valves, disk valves, or any other type of flow control device. When the valves 210, 212, and 214 are in the closed position (as illustrated), two chambers 220 and 222 are defined. The first and second chambers 220 and 222 correspond to the first and second chambers 114 and 124, respectively, in the tool string of FIG. 5. Both chambers 220 and 224 may be initially filled with a gas (e.g., air or nitrogen) or some other suitable compressible fluid. In one arrangement, the first chamber 220 is relatively small in volume, to create an underbalance condition prior to perforating, while the second chamber 222 is much larger to receive a fluid surge.

The valves 210, 212, and 214 are controlled by operators 216, 218, and 219, respectively. In one embodiment, the operators are activated by pressure communicated in the annulus region 206. The operators may thus be responsive to elevated pressures or to predetermined numbers of pressure cycles. Alternatively, the operators are responsive to low-level pressure pulse signals of predetermined amplitudes and periods. The operators 216, 218, and 219 are thus controllable from the surface. In yet other embodiments, other types of actuators can be used to control the operators 216, 218, and 219. Such other actuators include electrical actuators or mechanical actuators. The sequence of events shown in FIG. 6 may be performed with the tool string of FIG. 7.

When the tool string of FIG. 7 is run in, the valves 210, 212, and 214 are closed. Before shooting the gun 200, the first valve 210 is opened to enable communication with the first chamber 220 to create an underbalance condition. Fluid flows from the rat hole through ports 209 into the inner bore of the tubing 202 and to the first chamber 220. The gun 200 is then fired, with the gun dropped by an anchor 205 after firing. Thereafter, the second valve 212 may be opened to create a fluid surge from the formation 208 into second chamber 222. After the second chamber 222 has filled up, or after some predetermined time period, the third valve 214 may be opened to enable either production to the surface or application of injection pressure to inject the second chamber fluid back into the formation 208.

Using either the embodiments of FIGS. 5 and 7, the various events are achievable in a single trip. This avoids costs that may be incurred if multiple runs are needed. By performing the underbalance perforating in conjunction with subsequent surge, improved perforation tunnel characteristics may be achieved. Tool strings according to some embodiments employ at least two chambers initially at some low pressure (e.g., atmospheric pressure), with a first chamber to create the underbalance condition and a second chamber to provide the fluid surge.

Figure 8:
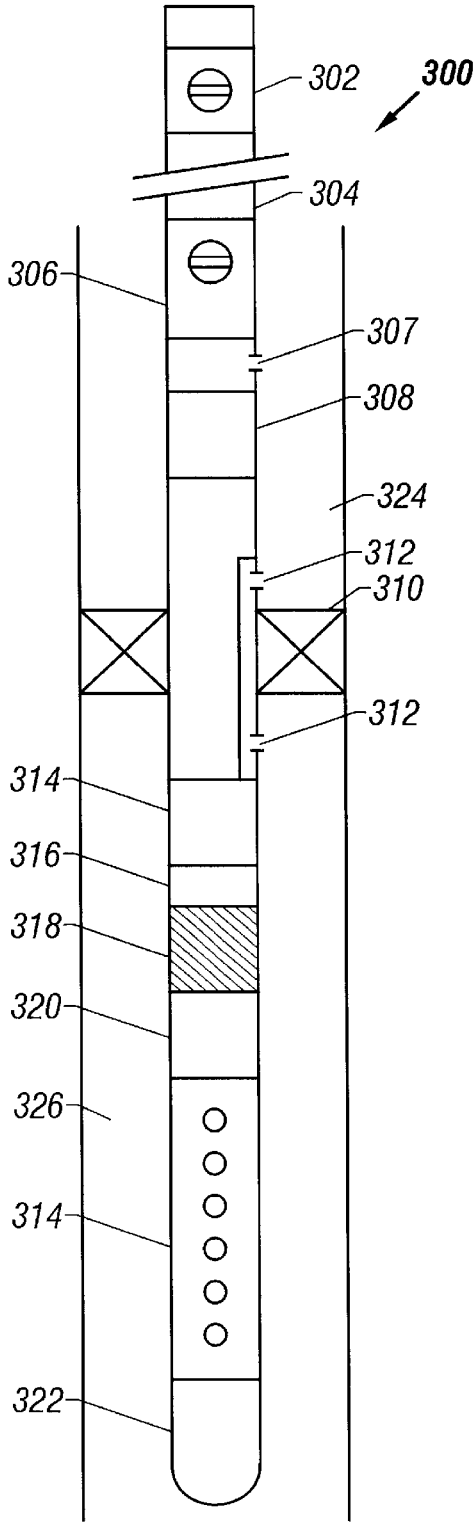
FIG. 8 illustrates a tool string according to another embodiment for creating an underbalance condition in a wellbore.

Referring to FIG. 8, a tool string 300 in accordance with another embodiment is illustrated. Similar to the tool string of FIG. 7, an atmospheric chamber 304 is defined between a first valve 302 (e.g., a ball valve) and a second valve 306 (e.g., a ball valve). A circulating valve 307 is also provided to enable communication between an inner bore of the tool string 300 and an annulus region 324 above a packer 310. The circulating valve 307 may include a sleeve valve, a disk valve, or any other type of valve to control fluid communication between the inside and outside of the tool string 300.

A pressure monitoring device 308 may also be attached to the tool string 300. The pressure monitoring device 308 is used to sense pressure conditions in the wellbore and to communicate the sensed pressure to the well surface. This may be accomplished by using electrical cabling. Alternatively, the pressure monitoring device 308 may include a storage device to store collected pressure data which may be accessed once the tool string 300 is retrieved to the surface.

The packer 310 may be attached below the pressure monitoring device. A pressure feed port 312 in the tool string below the packer 310 is provided to enable communication between a rat hole 326 (below the packer 310) and the inner bore of the tool string 300. If the circulating valve 307 is open, then fluid pressure in the rat hole 326 is communicated through the feed ports 312 to the annulus region 324.

In the example embodiment, the tool string 300 also includes a full bore firing head 314, a ballistic swivel 316, and an anchor 318 that may be explosively activated to release a perforating gun 314. Orienting weights 320 and 322 may be attached to the perforating gun 314 to orient the gun 314 in a desired azimuthal direction.

In accordance with some embodiments, the circulating valve 307 allows pressure in the rat hole 326 to be vented to a known level after the packer 310 is set. When setting a packer on a closed bottom hole (such as in a subsea well), the compression of setting the packer can pump up the well by up to about 800 psi. This may give uncertainty in the pressure below the packer 310 and hence in the perforating pressure. By opening the circulating valve, the rat hole 326 below the packer 310 may be vented to a known pressure level after the packer 310 is set and a BOP is set at the well surface.

After the circulation valve 307 is closed, the ball valve 306 may be opened to open the atmospheric chamber 304 to create an underbalance condition in the rat hole 326. A perforating or other operation may then be performed in the underbalance condition.

One aspect of some of the embodiments described above is that the formation that is being perforated remains isolated by a valve and/or a sealing element from a conduit that is in communication with the well surface. After perforation, the isolating device is removed to perform the surge. Such isolation is performed to prevent unwanted production of hydrocarbons to the well surface. For example, in FIG. 5, the flow control device 127 remains closed so that formation pressure does not escape up the tubing connected above the second chamber. The packer 120 prevents fluid communication up the annulus 122. In the example of FIG. 7, the valve 212 remains closed during perforation. In the example of FIG. 8, the valve 302 remains closed during perforation.

Figure 14:
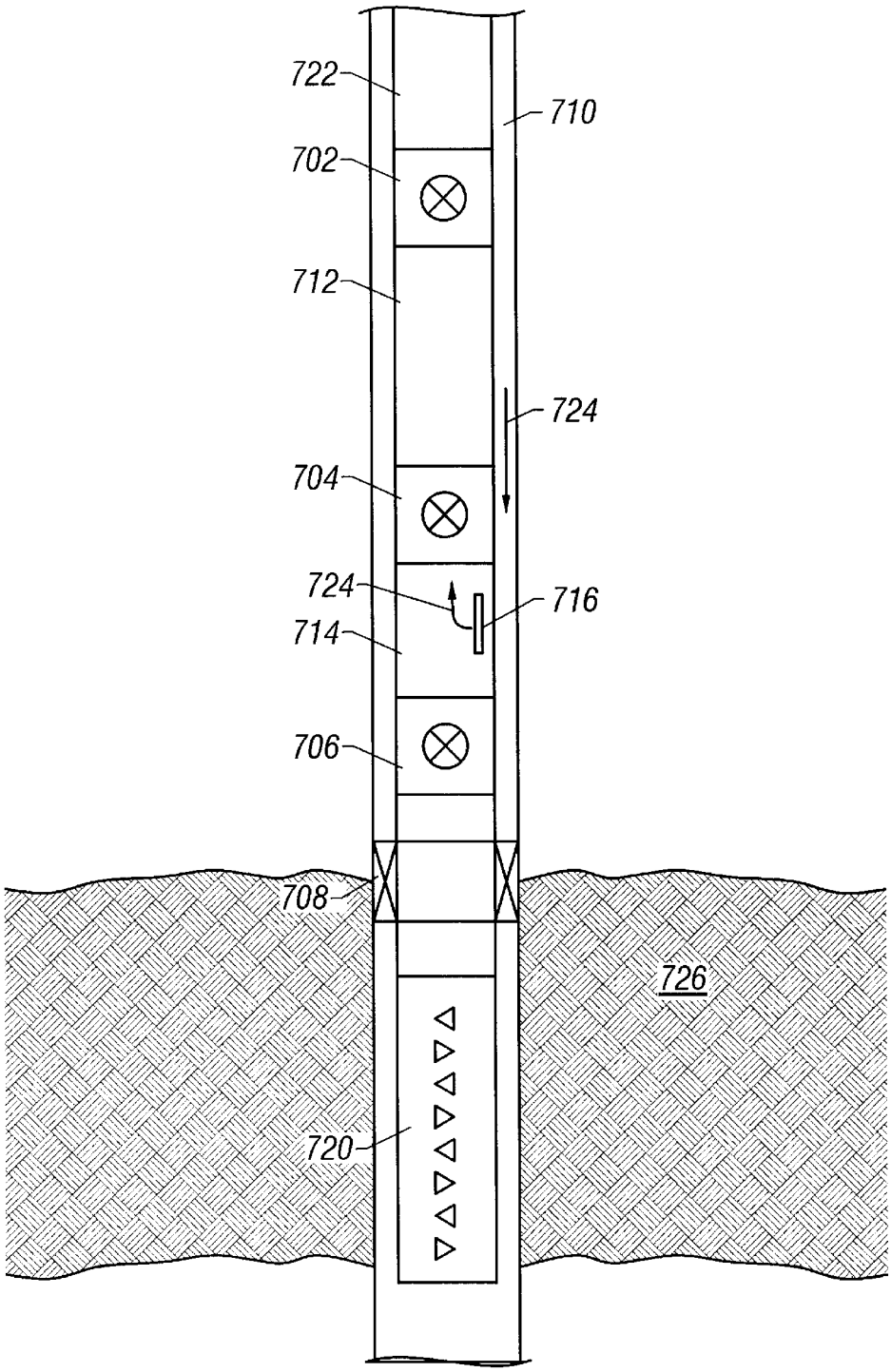
FIG. 14 illustrates an alternative embodiment of a tool string including a perforating gun and an apparatus to create a fluid surge.

FIG. 14 shows another embodiment, which includes a string having a tubing 722, three valves 702, 704, and 706, and a perforating gun 720. A packer 708 is set around the string to isolate an annulus 710. A chamber 712 between the valves 702 and 704 is initially at a relatively low pressure (lower than the surrounding wellbore pressure). The low pressure may be, for example, atmospheric pressure. The valves 702 and 704 may be mechanically, electrically, or hydraulically operable.

The valve 706, in one embodiment, may be operated by sending pressure pulse commands down the annulus 710. In addition to the valves 702, 710, and 712, a circulation valve 714 (which may include a sleeve 716) is included in the string illustrated in FIG. 14.

During run-in, the valves 702, 704, and 714 are closed, while the valve 706 is open. Once run to the desired depth, the packer 708 is set. The valve 704 is then opened, which causes a surge of pressure from the rat hole (beneath the packer 708) into the low pressure chamber 712. This causes the rat hole pressure to decrease to a target underbalance condition. The perforating gun 720 is then fired in the underbalance condition to create perforations in formation 726.

As a result of the fluid surge through the valve 704 as it is opening, the sealing elements of the valve 704 may be damaged. Consequently, the valve 704 may be rendered unusable. To maintain isolation of the formation, the valve 706 is used as a backup after the valve 704 has been opened.

After the surge and perforation operations, the valve 706 is closed (in response to signals sent down the annulus 710). Once closed, the valve 706 serves to isolate the formation 726. The valve 702 is then opened to enable communication with the inner bore of the tubing 722. The circulation valve 714 is then opened to enable reverse circulation of hydrocarbons in the string up to the well surface (the reverse circulation flow is indicated by the arrows 724).

Figure 15:
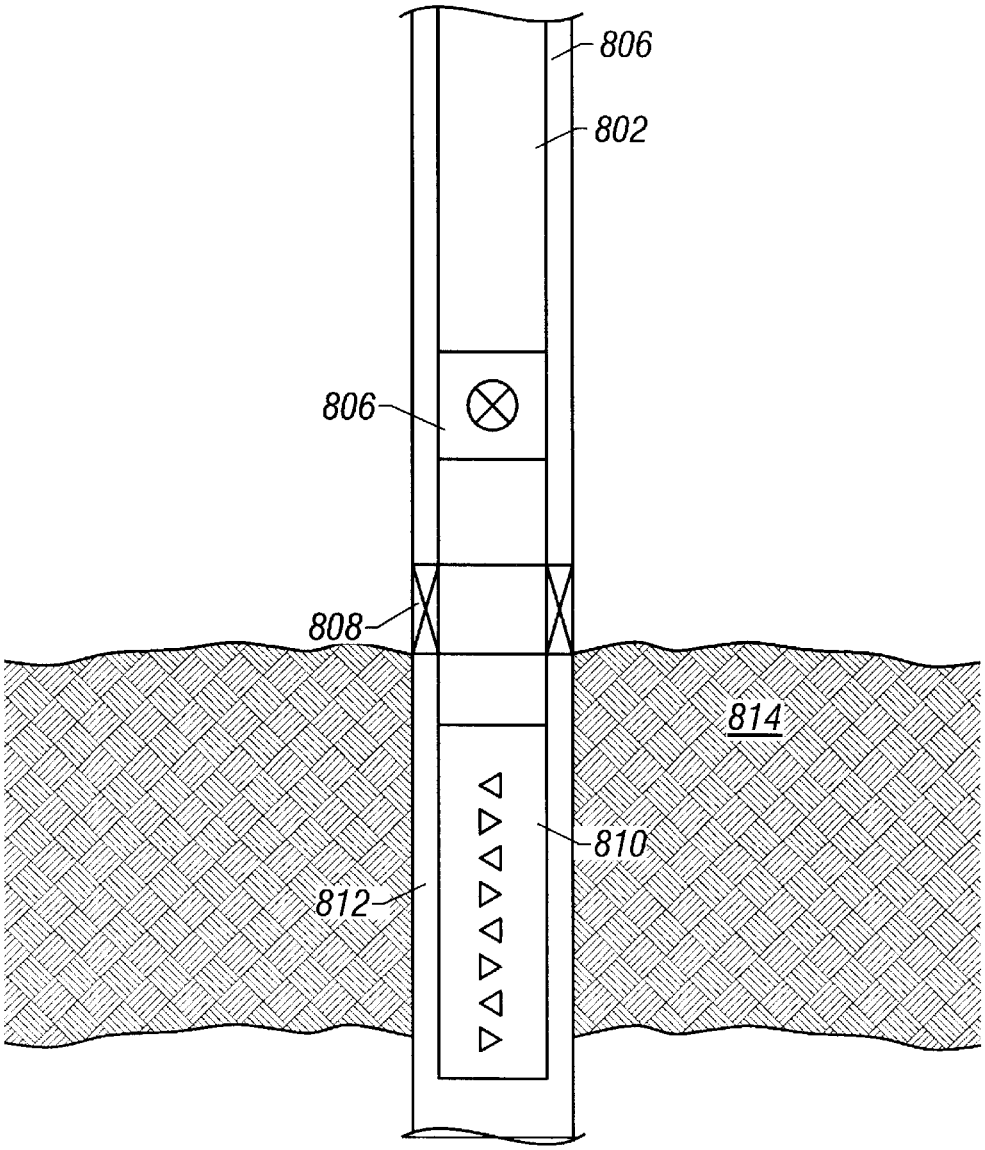
FIG. 15 illustrates yet another embodiment of a tool string including a valve that is actuatable between open and closed positions to create desired pressure conditions during perforating and a subsequent surge operation.

Referring to FIG. 15, in an alternative embodiment, a single valve 804 (e.g., a ball valve) is used. The ball valve 804 is part of a string that also includes a tubing or other conduit 802, a packer 808, and a perforating gun 810.

When run-in, the valve 804 is in the closed position. Once the string is lowered to the proper position, the valve 804 is opened, and the packer 808 is set to isolate an annulus region 806 above the packer 808 from a rathole region 812 below the packer 808. The internal pressure of the tubing 802 is bled to a lower pressure such that an underbalance condition is created in the rathole 802 proximal the perforating gun 810. After the tubing pressure has been bled to achieve a desired rathole pressure, the valve 804 is closed, and the perforating gun 810 is fired. Since the rathole 812 at this point has been bled to an underbalance condition, an underbalanced perforation is performed. Because the valve 804 is closed, the formation is isolated during perforation. The pressure inside the tubing is bled down further, such as to an atmospheric pressure. After the gun 810 is fired, the valve 804 is opened, which causes a surge of fluid from the rathole 812 into the inner bore of the tubing 802.

Figure 9:
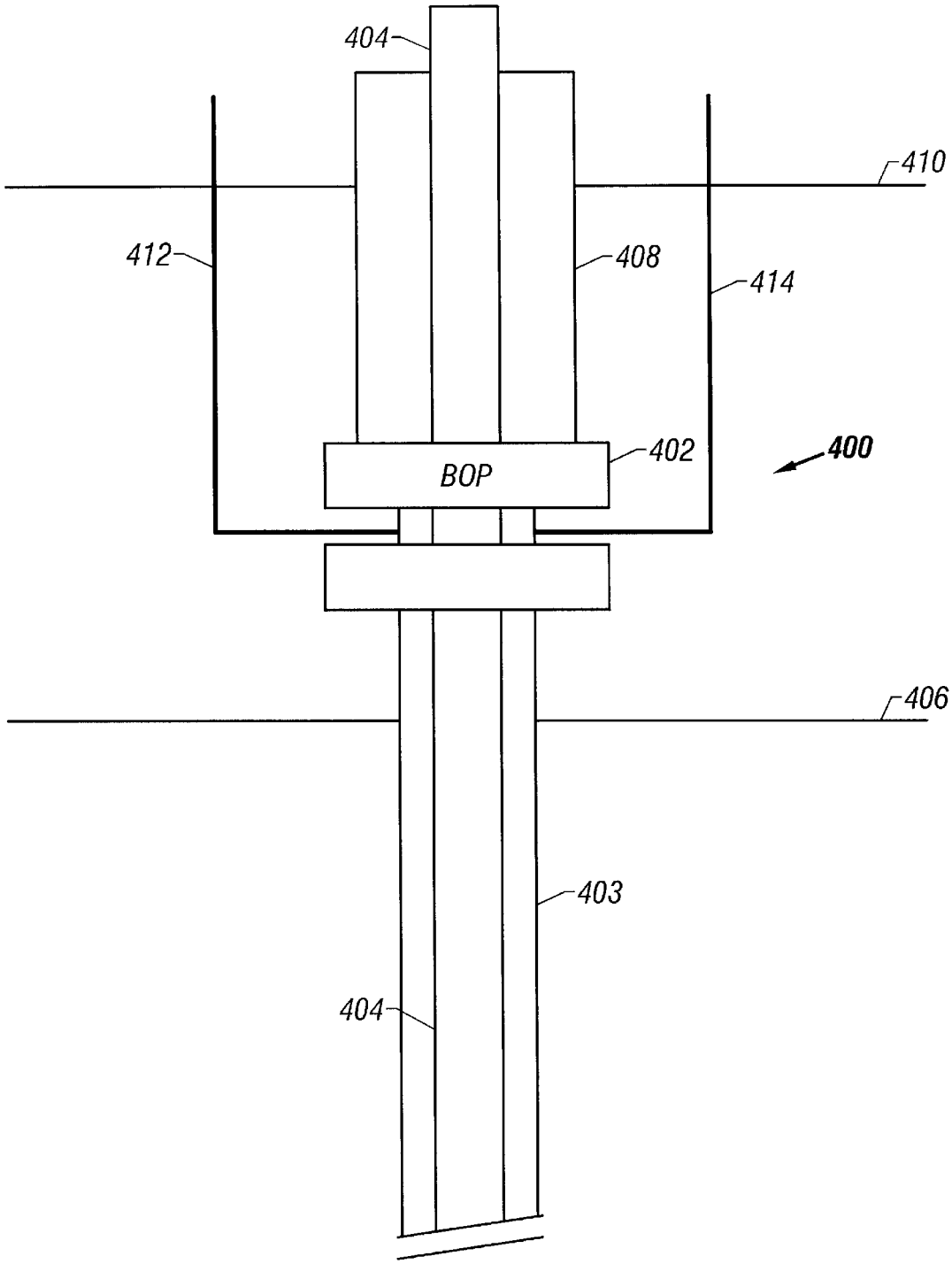
FIG. 9 illustrates subsea well equipment that is useable with the tool string of FIG. 8.

Referring to FIG. 9, a portion of subsea well equipment 400 is illustrated. The subsea well equipment 400 is connected to casing 403 and tubing 404 that extend into a subsea well. The wellhead equipment 400 includes a BOP 402 above the sea bed or mudline 406. The tubing 404 may extend through the BOP 402. The BOP 402 includes sealing rams that close on the tubing 404 to create a seal so that the wellbore below the BOP 402 is closed off from the surface. In a subsea well, the BOP 402 is used to prevent wellbore fluids from escaping to the well surface, which may pose environmental hazards. Above the BOP 402, the tubing 404 is enclosed within a marine riser 408. Both the marine riser 408 and the tubing 404 extend to the sea surface 410.

Various fluid communications lines extend from the subsea well equipment 400 to the sea surface 410. Examples of such fluid communications lines include a choke line 412 and a kill line 414. As illustrated, both the choke and kill lines 412 and 414 extend to a point below the BOP 402.

The subsea well equipment 400 may be used in conjunction with the tool string 300 (FIG. 8). As noted above, after the tool string 300 is run into the subsea wellbore, the packer 310 is set downhole. Setting of the packer 310 can pump up pressure in the well to an unknown level. To vent such pressure buildup, the circulating valve 307 may be opened to vent the pressure in the rat hole 326 before the BOP 402 is closed. The circulation valve 307 is then closed followed by closing of the BOP 402 on the tubing 404. Next, the atmospheric chamber 304 can be opened to create the underbalance condition in the rat hole 326. Following that, an underbalance perforating operation may be performed.

In accordance with another embodiment, an alternative procedure for creating an underbalance condition may be performed using the components of FIGS. 8 and 9. In this alternative procedure, the choke line 412 may be filled with a low density fluid (e.g., about 8.5 ppg). The kill line 412 may be filled with a heavy wellbore fluid (e.g., about 11.2 ppg). The tool string 300 can then be run into the wellbore on the tubing 404 with the circulation valve 307 in the open position. After the tool string 300 is lowered to a desired depth, the packer 310 is set. Since the circulating valve 307 is open, this prevents an unknown pressure buildup in the rat hole 326 below the packer 310. Thus, in one example, in an 11,000 feet well, the bottom hole pressure may be around 6,400 psi. After the packer 310 is set, the BOP 402 is closed on the tubing 404. The choke line 412 at this point is in its closed position while the kill line 414 is in its open position.

After the BOP 402 is closed, the choke line 412 can be opened below the BOP 402 while the kill line 414 is closed below the BOP 402. This reduces the wellbore pressure below the BOP 402. Since the circulating valve 307 is open, the rat hole pressure is also reduced. In one example, if the well is in 4,000 feet of water, the hydrostatic head may be reduced by up to 560 psi. The actual drop may be slightly less due to heavy fluid flowing into the choke line but the correction may be of second order.

An underbalance condition is thus created in the rat hole 326 below the packer 310. Next, the circulating valve 307 may be closed, followed by closing the choke line 412 below the BOP 402 and opening the kill line below the BOP. This restores the overbalance condition in the wellbore above the packer 310. Next, the perforating gun 314 may be perforated underbalance.

Figure 10:
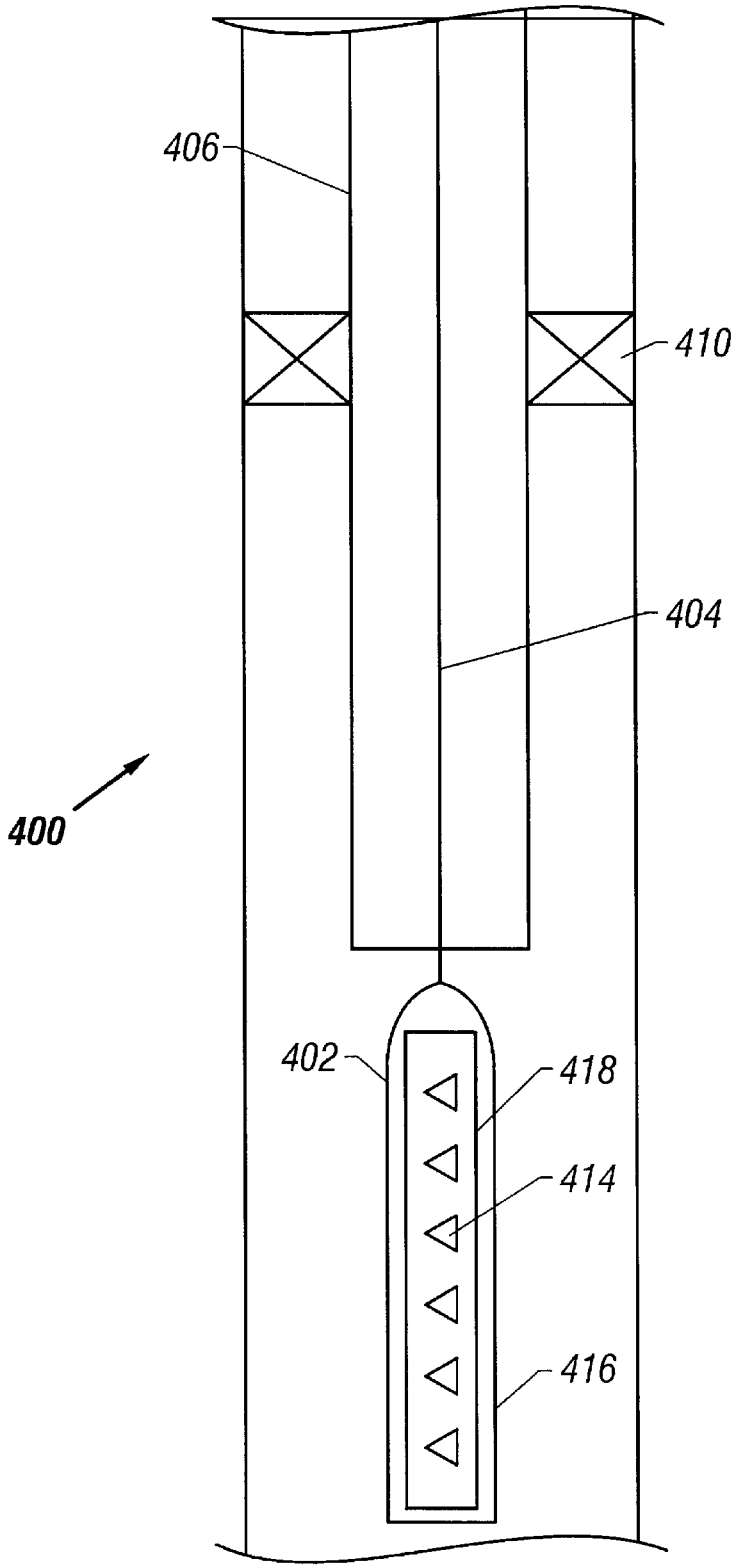
FIGS. 10 and 11 illustrate a perforating gun string positioned in a wellbore.

Referring to FIG. 10, yet another embodiment for creating an underbalance condition during a perforating operation is illustrated. A perforating gun string 400 includes a perforating gun 402 and a carrier line 404, which can be a slickline, a wireline, or coiled tubing. In one embodiment, the perforating gun 402 is a hollow carrier gun having shaped charges 414 inside a chamber 418 of a sealed housing 416. In the arrangement of FIG. 10, the perforating gun 402 is lowered through a tubing 406. A packer 410 is provided around the tubing 406 to isolate the interval 412 in which the perforating gun 402 is to be shot (referred to as the "perforating interval 412"). A pressure $P_W$ is present in the perforating interval 412.

Figure 11:
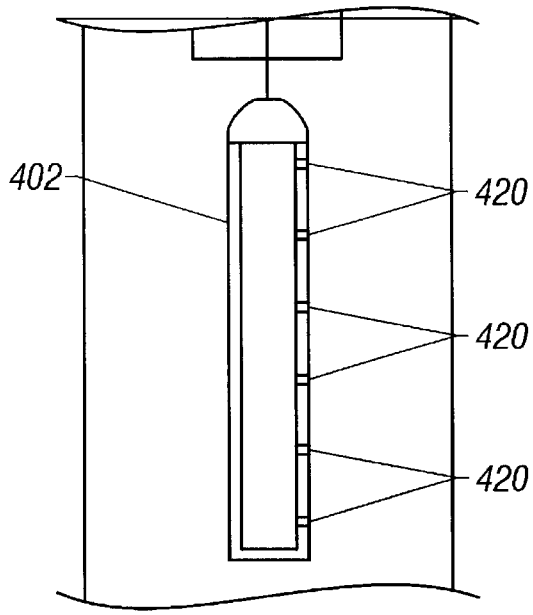

Referring to FIG. 11, during detonation of the shaped charges 414, perforating ports 420 are formed as a result of perforating jets produced by the shaped charges 414. During combustion of the shaped charges 414, hot detonation gas fills the internal chamber 418 of the gun 416. If the resultant detonation gas pressure, $P_G$, is less than the wellbore pressure, $P_W$, by a given amount, then the cooler wellbore fluids will be sucked into the chamber 418 of the gun 402. The rapid acceleration of well fluids through the perforation ports 420 will break the fluid up into droplets, which results in rapid cooling of the gas within the chamber 418. The resultant rapid gun pressure loss and even more rapid wellbore fluid drainage into the chamber 418 causes the wellbore pressure $P_W$ to be reduced. Depending on the absolute pressures, this pressure drop can be sufficient to generate a relatively large underbalance condition (e.g., greater than 2000 psi), even in a well that starts with a substantial overbalance (e.g., about 500 psi). The underbalance condition is dependent upon the level of the detonation gas pressure $P_G$, as compared to the wellbore pressure, $P_W$.

When a perforating gun is fired, the detonation gas product of the combustion process is substantially hotter than the wellbore fluid. If cold wellbore fluids that are sucked into the gun produce rapid cooling of the hot gas, then the gas volume will shrink relatively rapidly, which reduces the pressure to encourage even more wellbore fluids to be sucked into the gun. The gas cooling can occur over a period of a few milliseconds, in one example. Draining wellbore liquids (which have small compressibility) out of the perforating interval 412 can drop the wellbore pressure, $P_W$, by a relatively large amount (several thousands of psi).

In accordance with some embodiments, various parameters are controlled to achieve the desired difference in values between the two pressures $P_W$ and $P_G$ For example, the level of the detonation gas pressure, $P_G$, can be adjusted by the explosive loading or by adjusting the volume of the chamber 418. The level of wellbore pressure, $P_W$, can be adjusted by pumping up the entire well or an isolated section of the well, or by dynamically increasing the wellbore pressure on a local level.

Figure 12:
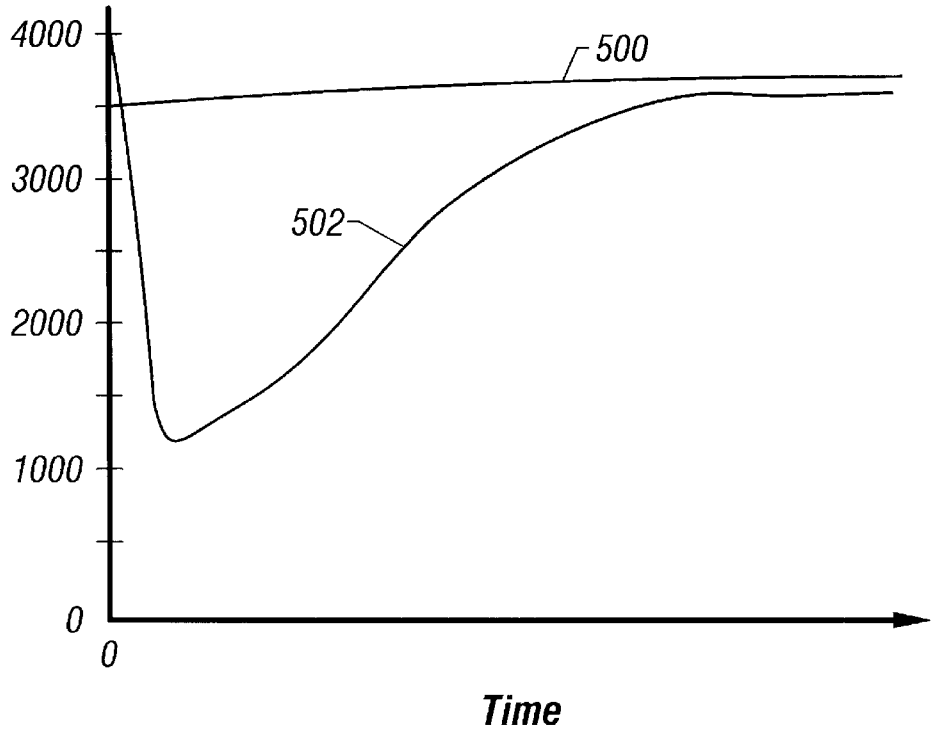
FIG. 12 is a graph illustrating the wellbore pressure during detonation of the perforating gun string.

Referring to FIG. 12, a graph illustrates a simulated perforating operation over time. In the graph, the wellbore pressure is initially at 4000 psi, as indicated by curve 502, with the pore or formation pressure at 3500 psi, as indicated by curve 500. This represents an overbalance condition of about 500 psi. Upon detonation, the gas pressure in the gun 402 is about 2700 psi. The rapid influx of fluid into the gun cools the gas, which results in rapid filling of the gun chamber 418 and a relatively large wellbore pressure drop, as indicated by the curve 502. Initially, the overbalance was about 500 psi. However, shortly after detonation of the gun, the wellbore pressure drops relatively sharply, creating an underbalance of more than about 2000 psi.

For the system illustrated in FIGS. 10 and 11 to be effective, the pre-detonation wellbore pressure must be greater than the detonation gas pressure, and the post-detonation wellbore must be below the pore or formation pressure by the level required to generate underbalance cleanup.

Figure 13:
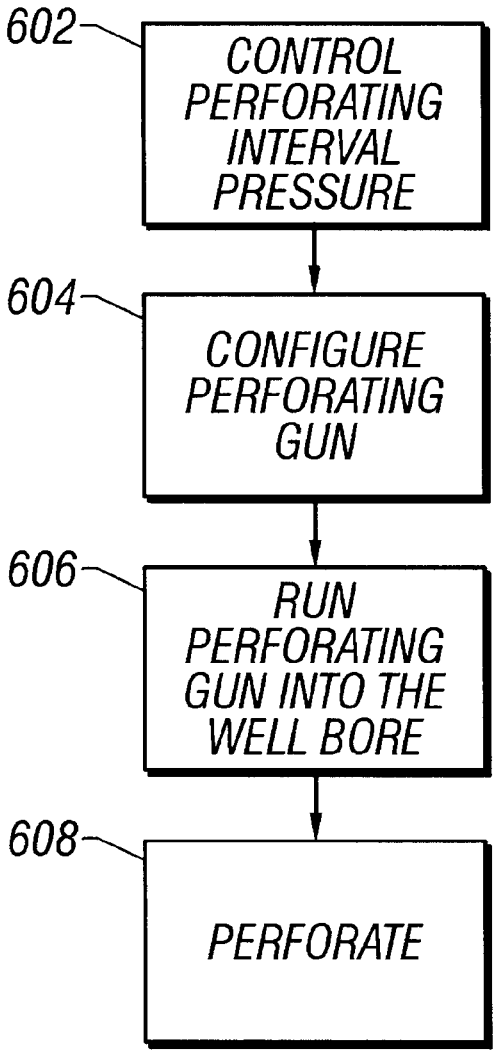
FIG. 13 is a flow diagram of a process in accordance with an embodiment of the invention.

Referring to FIG. 13, a process of controlling parameters to achieve the underbalance in the perforating interval is illustrated. The pressure of the perforating interval is controlled (at 602). The wellbore pressure can be controlled by pumping up from the surface or pumping up under a packer. If the desired wellbore pressure cannot be attained by a regular hydrostatic or pump-up mechanisms, then a transient pressure adjustment can be used using a local pressure generating device. For example, a small pyrotechnic or ballistic charge can be used to raise the pressure in a similar manner to opening an atmospheric chamber. The pyrotechnic or ballistic charge can be detonated slightly before the main charges within the gun 402 to ensure that the pressure wave travels along the gun before the gun is shot. Alternatively, the pyrotechnic or ballistic charge can be set off simultaneously with the shaped charges in the gun 402. In another arrangement, a high pressure air or other gas chamber can be used and opened to increase pressure in the well.

In addition to controlling the wellbore pressure, $P_W$, the expected detonation gas pressure also needs to be controlled (at 604). The detonation gas pressure can be increased by reducing the "dead" or unused volume inside the gun. This can be accomplished by reducing the total volume of the chamber 418. Alternatively, the explosive loading can be increased, which can be accomplished by increasing the number of charges in the chamber 418 or by using larger charges.

The detonation pressure can be reduced by increasing the volume of the gun chamber 418 or by adding empty spacers (in place of shaped charges) inside the gun 402. Shot density can also be reduced, or smaller charges can be employed to reduce detonation pressure. Using oriented perforating with a lower shot density than a fully loaded gun can also reduce the detonation pressure.

After the wellbore pressure $P_W$ is set to the desired level and the perforating gun has been configured to achieve a desired detonation gas pressure, the perforating gun string is run (at 606) into the wellbore. Once the gun string is at the proper depth, the perforating gun string is perforated (at 608). As discussed above, an underbalance condition is created during the perforation.

Figure 16:
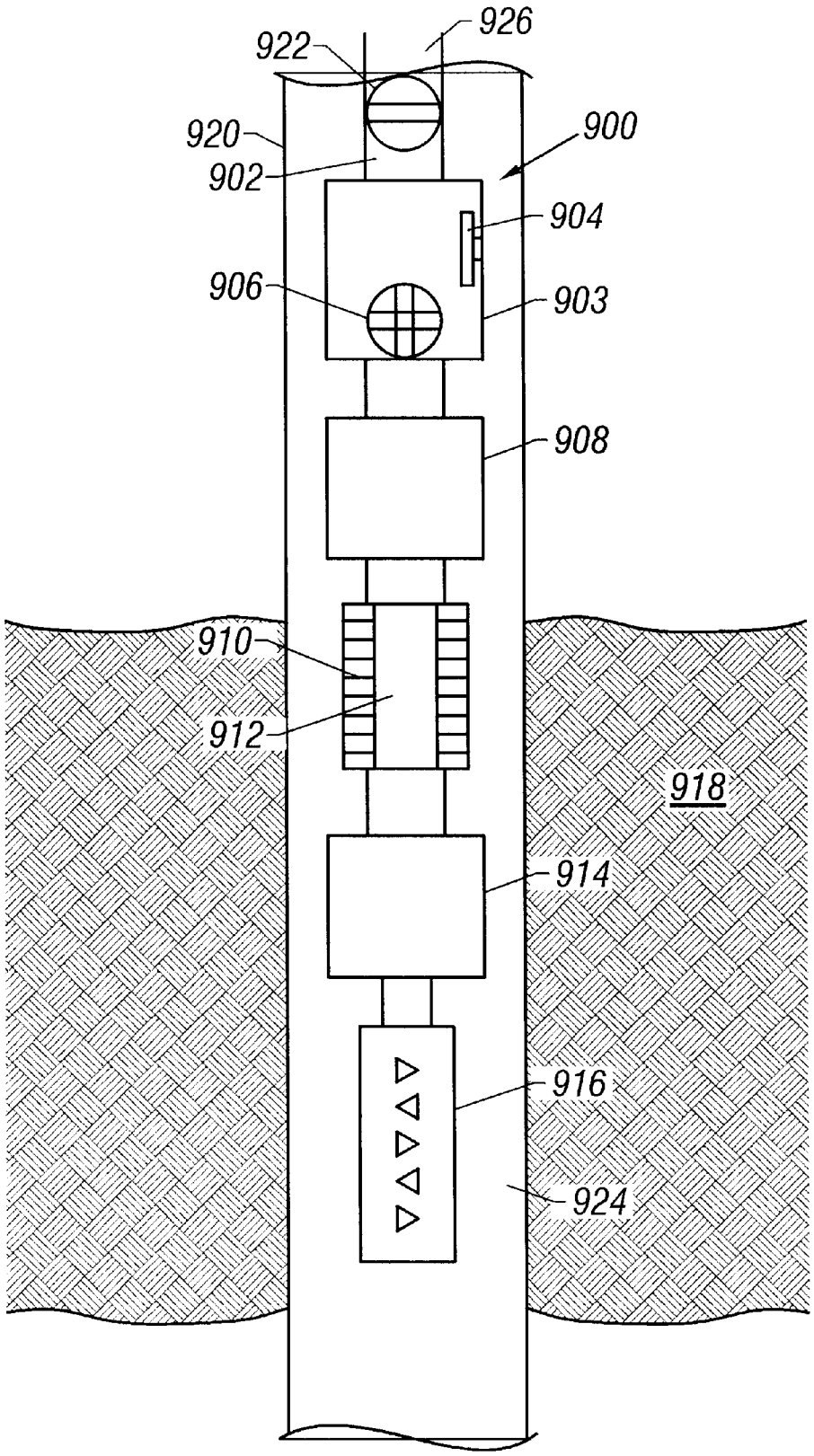
FIG. 16 illustrates a tool string for performing a perforate-surge-gravel pack operation, in accordance with another embodiment.

Referring to FIG. 16, according to another application, an embodiment of a tool string 900 can be used to perform a perforate-surge-gravel pack operation, in which perforation is followed by a fluid flow surge, which is then followed by a gravel pack operation. Alternatively, instead of a perforate-surge-gravel pack operation, another embodiment can perform a perforate-surge-fracture operation.

As shown in FIG. 16, the tool string 900 is carried by a tubing (e.g., coiled tubing) 902, which is attached to a dual-valve system 903 that includes a circulating valve 904 and a second valve 906. The circulating valve 904, in one embodiment, is implemented with a sleeve valve, while the second valve 906, in one embodiment, is implemented with a ball valve. Another valve 922 (e.g., a ball valve) is provided above the dual-valve system 903. When the valve 922 and valve 906 are closed, a sealed chamber is defined therebetween. A low pressure (e.g., atmospheric pressure) can be trapped inside the chamber.

The tool string 900 further includes an upper packer 908 and a perforating packer 914. Between the packers 908 and 914 is a sand screen assembly that includes a blank pipe 912 and a screen 910 around the pipe 912. The sand screen 910 is used as a sand filter in production operations of hydrocarbons from the surrounding formation 918. A perforating gun 916 is coupled below the perforating packer 914.

In operation, the tool string 900 is run-in with the circulating valve 904 in the closed position and the ball valves 906 and 922 in the closed position. When the tool string is lowered to a desired depth, the perforating packer 914 is set. The valve 906 is then opened to communicate the chamber defined between the valves 906 and 922 to communicate with the rat hole 924 surrounding the perforating gun 916 with the lower pressure in the chamber. Because of the presence of a low pressure in the chamber, an underbalance condition is created in the rat hole 924. The perforating gun 916 is then fired to create perforations in the surrounding formation 918.

Upon detonation, the perforating gun 916 drops to the bottom of the wellbore 920. At this time, a second chamber 926 above the valve 922 is bled down to a relatively low pressure (e.g., atmospheric pressure). The valve 922 is then opened to create a sudden surge of fluid flow into the second chamber 926. This creates a sudden underbalance condition in the wellbore region 922 proximal the formation 918 to clean out the perforations that were just formed in the formation 918.

A flow of hydrocarbons is then produced up the tubing 902 for test purposes. After the test flow is completed, the valve 906 is closed, and the circulating valve 904 is opened to perform a reverse circulation of fluids.

The valve 906 is then opened to enable equalization of pressure throughout the string, and the packer 914 is then set. The tool string 900 is then lowered further into the wellbore 920 until the sand screen assembly is positioned adjacent the perforations in the formation 918. The packer 914 is then reset, followed by setting of the upper packer 908. The two packers 908 and 914 isolate a region around the sand screen assembly so that a gravel pack slurry can be pumped down the tubing and out through the sand screen 910 into an annulus region surrounding the sand screen 910. Alternatively, instead of performing a gravel pack operation, the tool string 900 can be modified to enable a fracturing operation, in which a fracturing material is injected down the tubing 902 (instead of the gravel pack slurry) for communication into the formation 918 to extend fractures in the formation 918.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A tool string for use in a wellbore, comprising:

an assembly having at least a first chamber and a second chamber; and control elements to enable communication with the first chamber to create an underbalance condition in the wellbore and to enable communication with the second chamber to create a flow surge from a formation, wherein the first chamber has a first volume and the second chamber has a second volume larger than the first volume.

2. The tool of claim 1, further comprising a perforating gun activatable when an underbalance condition is created to perform underbalance perforating.

3. The tool string of claim 1, wherein the control elements include flow control devices.

4. The tool string of claim 3, wherein the flow control devices include valves.

5. The tool string of claim 3, wherein at least one of the flow control devices includes ports that are explosively actuatable.

6. The tool string of claim 1, further comprising a flow control device in communication with the second chamber to control production or injection of fluid in the second chamber.

7. The tool string of claim 1, wherein the control elements comprise at least one port and an explosive element adapted to open the port.

8. The tool string of claim 7, further comprising a gun and a timer mechanism adapted to provide a delay between activation of the explosive element and the gun.

9. The tool string of claim 7, wherein the explosive element includes a detonating cord.

10. The tool string of claim 1, wherein each of the first and second chambers has an inner pressure lower than a pressure of a formation proximal the first and second chambers.

11. The tool string of claim 1, wherein at least one of the first and second chambers contains a gas.

12. The tool string of claim 1, further comprising a tool to operate in the underbalance condition.

13. The tool string of claim 12, wherein the tool comprises a perforating gun.

14. The tool string of claim 12, wherein the tool comprises a jet cutter.

15. The tool string of claim 1, wherein the control elements are activatable by command from the surface to control opening communication with the first and second chambers.

16. The tool string of claim 1, further comprising a tool to operate in the underbalance condition, the tool being releasable from the tool string.

17. A method for use in a wellbore, comprising:

lowering a tool string having a first chamber into the wellbore proximal a formation;

activating at least one explosive element to open communication with the chamber to create an underbalance condition in the wellbore proximal the formation;

activating a perforating gull in the tool string once the underbalance condition is created;

opening communication with a second chamber in the tool string to create a fluid flow surge from the formation into the second chamber; and providing activation commands from the surface to control opening of communication with the first and second chambers.

18. The method of claim 17, further comprising checking for the underbalance condition and not activating the perforating gun until the underbalance condition is present.

19. The method of claim 17, further comprising using a timer mechanism to control delay between opening communication with the first chamber and activating the perforating gun.

20. The method of claim 19, further comprising using a timer mechanism to control delay between activating the perforating gun and opening communication with the second chamber.

21. The method of claim 17, further comprising checking for downhole conditions before opening communications with the first and second chambers.

22. The method of claim 17, further comprising producing the fluid in the second chamber to the surface.

23. The method of claim 22, further comprising isolating the second chamber from the formation before producing the second chamber fluid.

24. A method for use in a wellbore, comprising:

lowering a tool string having a first chamber into the wellbore proximal a formation;

activating at least one explosive element to open communication with the chamber to create an underbalance condition in the wellbore proximal the formation;

activating a perforating gun in the tool string once the underbalance condition is created;

opening communication with a second chamber in the tool string to create a fluid flow surge from the formation into the second chamber; and releasing the perforating gun before opening communication with the second chamber.

25. A method for use in a wellbore, comprising:

lowering a tool string having a first chamber into the wellbore proximal a formation;

activating at least one explosive element to open communication with the chamber to create an underbalance condition in the wellbore proximal the formation;

opening communication with a second chamber in the tool string to create a fluid flow surge from the formation into the second chamber; and injecting the fluid in the second chamber back into the formation.

26. A tool string for use in a wellbore, comprising:

a container including a first chamber at a predetermined low pressure;

one or more ports to enable communication with the first chamber to create an underbalance condition in the wellbore;

at least one explosive element adapted to open the one or more ports; and a second chamber to receive a surge of fluid from a formation, wherein the second chamber has a volume larger than the first chamber, the second chamber being at a predetermined low pressure.

27. The tool string of claim 26, wherein the first chamber includes a gas.

28. The tool string of claim 26, further comprising a perforating gun, wherein activation of the perforating gun substantially coincides with opening of the one or more ports.

29. A method for use in a wellbore comprising:

providing an assembly having at least a first chamber and a second chamber;

activating communication with the first chamber to create an underbalance condition in the wellbore;

activating communication with the second chamber to create a fluid flow surge from a formation surrounding the wellbore;

operating a tool in the underbalance condition; and releasing the tool before activating communication with the second chamber.

30. A method for use in a wellbore comprising:

providing an assembly having at least a first chamber and a second chamber;

activating communication with the first chamber to create an underbalance condition in the wellbore;

activating communication with the second chamber to create a fluid flow surge from a formation surrounding the wellbore; and injecting fluid from the second chamber back into the formation.

31. The method of claim 30, further comprising firing a perforating gun after the underbalance condition is created.

32. The method of claim 31, wherein activating communication with the second chamber is performed after firing the perforating gun.

33. The method of claim 30, wherein activating communication with at least one of the first and second chambers is accomplished by activating an explosive element.

34. The method of claim 30, wherein activating communication with at least one of the first and second chambers is accomplished by opening flow control devices.

35. The method of claim 30, wherein providing the first and second chambers comprises providing the first and second chambers having inner pressures lower than that of the formation.

36. The method of claim 30, wherein activating communication with the second chamber occurs after operating the tool.

37. The method of claim 30, further comprising providing activation commands from the surface to activate communication with the first and second chambers.

* * * * *

UNITED STATES PATENT AND TRADEMARK OFFICE

CERTIFICATE OF CORRECTION

PATENT NO. : 6,598,682 B2
DATED : July 29, 2003
INVENTOR(S) : Ashley B. Johnson et al.

It is certified that error appears in the above-identified patent and that said Letters Patent is hereby corrected as shown below:

Title page,
Item [74], *Attorney, Agent, or Firm*, delete "Brigitte Jeffrey" and insert -- Brigitte Jeffery --.

Column 8,
Line 3, delete "activate" and insert -- activated --.

Column 12,
Line 28, delete "sea bed" and insert -- seabed --.

Column 16,
Line 63, delete "gull" and insert -- gun --.

Signed and Sealed this

Fifth Day of October, 2004

JON W. DUDAS
*Director of the United States Patent and Trademark Office*